United States Patent [19]

Klein

[11] 4,080,984

[45] Mar. 28, 1978

[54] SUMP AND SUMP PUMP COVER

[76] Inventor: Robert Klein, 1112 S. Oak Circle Dr., Ingleside, Ill. 60041

[21] Appl. No.: 706,164

[22] Filed: Jul. 19, 1976

[51] Int. Cl.[2] ..... F16K 27/12

[52] U.S. Cl. ..... 137/371; 49/465; 220/251

[58] Field of Search ..... 49/465, 466; 52/19–21; 137/371; 220/251; 404/25; 417/40

[56] References Cited

U.S. PATENT DOCUMENTS

| | | | |
|---|---|---|---|
| 135,822 | 2/1873 | La Forge | 137/371 |
| 154,408 | 8/1874 | McKnight | 137/371 |
| 1,229,429 | 6/1917 | Farley | 137/371 |
| 2,057,866 | 10/1936 | Weber | 49/465 |
| 2,697,389 | 12/1954 | Heckman | 49/465 |
| 2,918,016 | 12/1959 | Olson | 417/40 X |
| 3,699,730 | 10/1972 | Humphrey | 137/371 X |
| 3,911,635 | 10/1975 | Traupe | 52/20 X |

*Primary Examiner*—Robert G. Nilson
*Attorney, Agent, or Firm*—Robert D. Farkas

[57] ABSTRACT

A sealed sump and sump pump cover that is especially adapted to cover a sump hole that is fitted with a sump cover, thereby providing both an attractive as well as a functional service.

3 Claims, 5 Drawing Figures

SUMP AND SUMP PUMP COVER

BACKGROUND OF THE INVENTION

This invention relates to a sealing cover especially adapted to cover a sump hole that has a sump pump therein. More particularly, the invention relates to such a device that is generally universally employable and easily installed.

Many restaurants, institutions and basements were originally constructed and many still are without provision for a floor drain. Canneries and food processing establishments, where a high degree of sanitation is required, necessitate floor scrubbing and flushing and may not be adequately equipped with floor drains.

Consequently, if flushing or flooding of the floors is a cleanliness requirement, floor sumps must be installed to collect the water. As a result of this need, standard diameter sumps in addition to sump pumps and sump conduits are needed and have been developed. Very little has been done, however, in the way of sump pump covers, except for a circular or rectangular lid that drops into place over the sump itself. As sumps are generally 18 inches in diameter and approximately 24 inches deep, this type of arrangement can be hazardous if the lid is not firmly seated.

The prior art teaches a variety of sump pumps and covers integral therewith, for example, U.S. Pat. Nos. 2,687,693; 2,804,019; 2,918,016; 3,280,751; 3,807,900; and others.

The foregoing are deficient, however, in that they fail to provide for adequate covering of the sump itself and they are not universally acceptable.

SUMMARY OF THE INVENTION

It is accordingly an object of the instant invention to provide for an improved sump cover.

It is another object of the invention to provide for a sump cover that is adapted to be employed in conjunction with most conventional sump pumps.

It is a further object of the invention to provide for the same at relatively little cost and for one that may easily be installed by most laymen.

These and other objects of the invention will become more apparent from the following detailed disclosure and claims and by reference to the accompanying drawings, in which:

Figure 1:
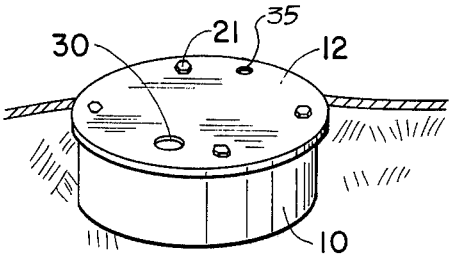
FIG. 1 is a side elevational view of the cover in place over a sump.
Figure 2:
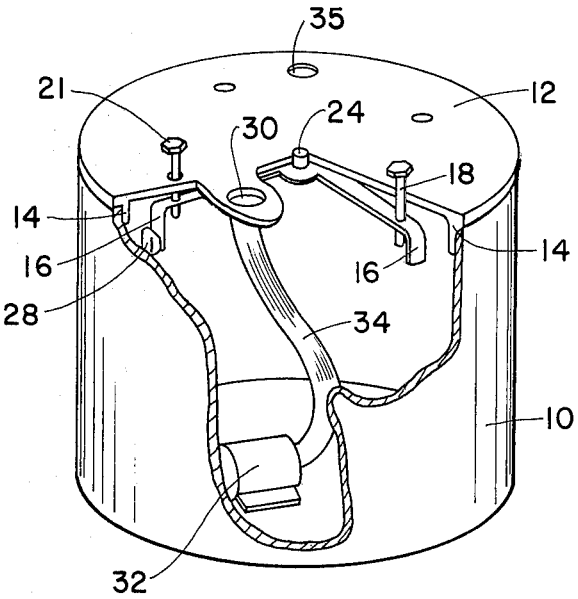
FIG. 2 is a fragmentary view thereof.
Figure 3:
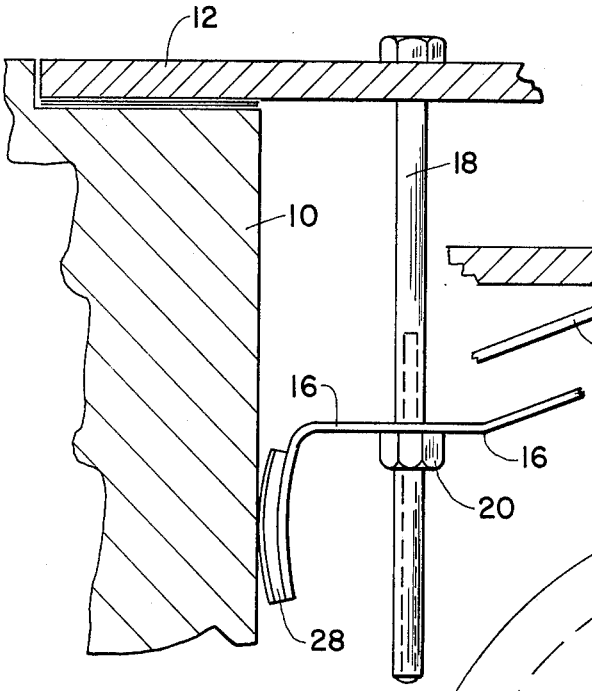
FIG. 3 is a fragmentary detailed view of a portion of the converting means.
Figure 4:
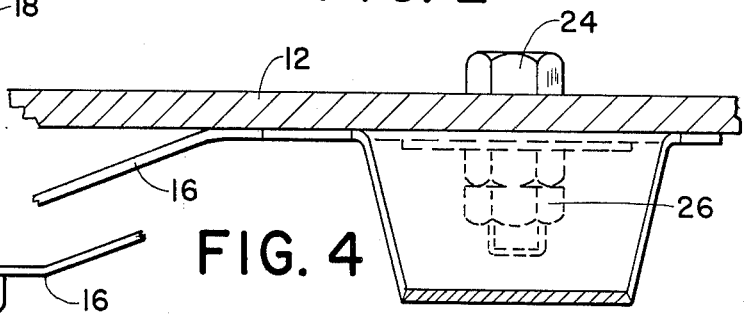
FIG. 4 is similar to FIG. 3 but of another portion thereof.
Figure 5:
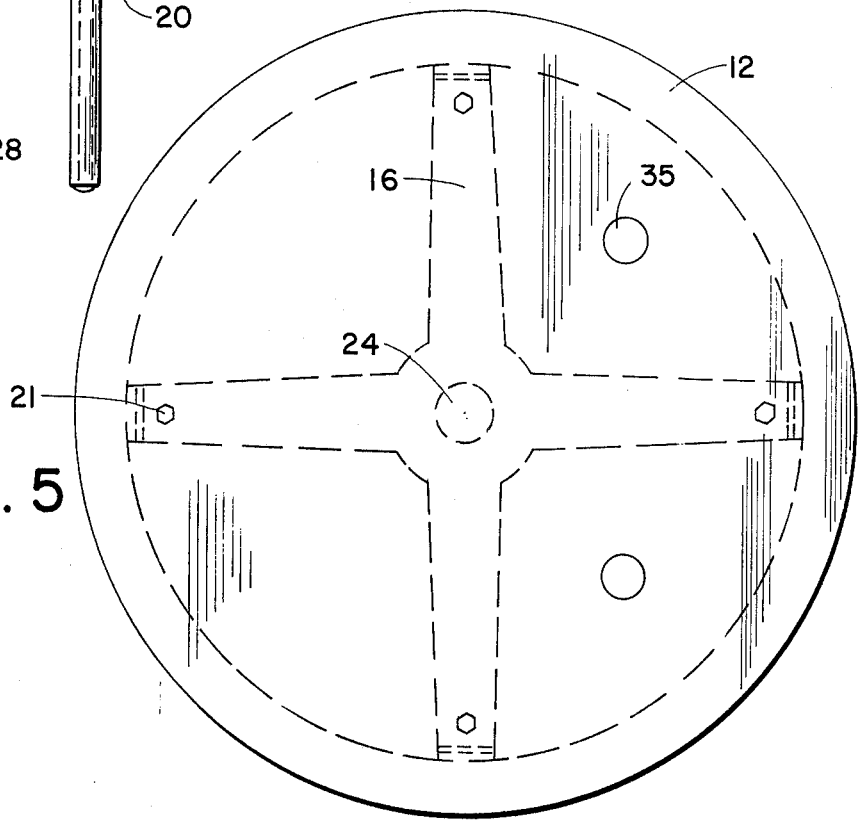
FIG. 5 is a perspective view looking down through the top of the cover showing the locking means.

The present cover is provided to be standard, safe and attractive. Basically, the invention includes the provision of a sump cover assembly especially adapted to be used in conjunction with a sump and sump pump, comprising a walled hollow housing having a predetermined internal diameter and being open at both ends and adapted to sit in the sump over the pump, a cover portion having a peripherally disposed flange, the cover portion having a diameter less than that of the housing, the cover portion being adapted to engage and cover, substantially sealing one open end of the housing, the cover portion defining a plurality of apertures, locking means disposed on the cover and adapted to engage frictionally the interior walls of the housing, the means communicating with the cover by fastening means engaging the apertures and a further aperture adapted to receive the sump pump discharge line therethrough.

DETAILED DISCLOSURE

Referring more particularly to the drawings, in which like elements are designated by like numerals, there is shown a substantially hollow cylindrical sleeve 10 that in the preferred embodiment is open at both ends. Integral therewith there is disposed a cover portion 12 that is disc shaped and adapted to cover the open top portion of the sleeve 10. The cover 12 will include a circumferential flange 14 therearound to facilitate engaging the interior wall of the sleeve 10. The external diameter of the cover 10 measured from the flange 14 will be slightly smaller than the internal diameter of the sleeve 10. It is to be understood that the sleeve 10 and cover 12 may also be square, rectangular, etc., with the above provisions being met as to fitting.

The sleeve 10 can be a metal cylinder, some 21 inches in diameter. The sleeve and cover may be made of a solid, non ferrous (ceramic tile) material and the sleeve can be perforated with a pattern of holes or slots to form a grill. The sleeve 10 is meant to be sealed to the top of the sump walls, and is recessed into the floor so that it is flush with the adjoining surfaces. Access holes are provided for wiring or pump outlets if required.

The device will be provided with at least one locking means i.e., a multi pronged four armed spring steel spider 16 that engages the interior side walls of the sleeve 10 at any position, the spider 16 being adjustable relative in height along sleeve 10 by sliding upon shaft 18 of a headed bolt 21 or the like and being held in place by a nut 26 thereon at the desired height. Spider 16 will be engaged to and in communication with the cover 12 by the bolt 21 and centrally, if desired by a further bolt 24 having locking means 26 thereon, such as a threaded nut.

Bolts 21 are peripherally disposed on cover 12 and are used to pull the spider arms 16 up and against the wall of the sleeve 10. A rubber shoe 28 may be attached to the extremity of each spider arm so as to form a resilient, friction pad. Thus, when the four arms are pulled up against the sleeve 10, the cover 12 is held firmly in place.

If desired, in addition to the apertures defined in the cover 10 for the bolts 21 and 24, there may be a further aperture 30 to accommodate passage of the sump pump 32 conduit line 34 therethrough to the external point of ultimate drainage.

It is to be understood that any suitable locking means such as spider 16, may be employed as well as those of means 21 and 24.

Since it is obvious that numerous changes and modifications can be made in the above-described details without departing from the spirit and nature of the invention, it is to be understood that all such changes and modifications are included within the scope of the invention.

I claim:

1. A sump cover assembly especially adapted to be used in conjunction with a sump and sump pump, comprising a walled hollow housing, said housing having internal wall surfaces having a predetermined internal diameter, said housing being open at both ends and adapted to sit in said sump over said pump, a cover portion having a peripherally disposed downwardly depending flange, said flange having an outside diameter less than that of said internal diameter of said housing, said cover portion being adapted to engage and cover, substantially sealing the uppermost open end of said housing, said cover portion defining a plurality of apertures, locking means disposed on said cover and adapted to engage adjustably frictionally said interior surfaces of said housing, said locking means being a multi-pronged assembly, each prong of said multi-prong assembly frictionally engaging a portion of said internal wall surfaces having a smooth surface, said pronged assembly being a multi-armed spring spider, said spider being disposed residing substantially parallel to said cover portion, said pronged assembly including resilient arm portions, said arm portions including rubber shoes on the free ends thereof, said locking means communicating with said cover by adjustable fastening means engaging some of said plurality of apertures, said fastening means being threaded bolts and threaded nuts, said threaded bolts passing through said some of said plurality of apertures, said threaded bolts passing through openings in said arms, said threaded nuts being disposed adjacent to the free ends of threaded bolts, wherein rotating said threaded bolts causes said arms to extend radially outwardly and upwardly from the central axis of said spider so as to have said rubber shoes engage said smooth portions of said internal surface of said housing, and one of said plurality of apertures adapted to receive a sump pump discharge line therethrough.

2. The assembly as defined in claim 1 wherein said housing and said cover portion are substantially circular in shape.

3. The assembly as defined in claim 1 wherein said housing is constructed of a non-ferrous substance.

* * * * *